United States Patent [19]

Davis, Jr. et al.

[11] Patent Number: 4,785,894

[45] Date of Patent: Nov. 22, 1988

[54] APPARATUS FOR DETECTING DRILL BIT WEAR

[75] Inventors: Albert P. Davis, Jr., Houston; Joseph W. Stolle, Wharton, both of Tex.

[73] Assignee: Exxon Production Research Company, Houston, Tex.

[21] Appl. No.: 166,592

[22] Filed: Mar. 10, 1988

[51] Int. Cl.[4] ..... E21B 12/02

[52] U.S. Cl. ..... 175/39

[58] Field of Search ..... 175/39, 40; 73/151

[56] References Cited

U.S. PATENT DOCUMENTS

| | | | |
|---|---|---|---|
| 2,239,106 | 4/1941 | Krall | 255/61 |
| 2,560,328 | 7/1951 | Bielstein | 255/61 |
| 2,580,860 | 1/1952 | Stokes | 255/61 |
| 2,925,251 | 2/1960 | Arps | 255/1.8 |
| 3,011,566 | 12/1961 | Graham | 175/39 |
| 3,062,302 | 11/1962 | Toth et al. | 175/39 |
| 3,345,867 | 10/1967 | Arps | 73/151 |
| 3,363,702 | 1/1968 | Bielstein | 175/39 |
| 3,853,184 | 12/1974 | McCullough | 175/39 |
| 4,655,300 | 4/1987 | Davis et al. | 175/39 |

*Primary Examiner*—Stephen J. Novosad
*Assistant Examiner*—Terry Lee Melius
*Attorney, Agent, or Firm*—Richard F. Phillips

[57] ABSTRACT

An earth drilling bit incorporating a bit wear indicator. The bit wear indicator includes: a sensor to detect wear at a selected point on the bit; a device for altering the resistance of the bit to receiving drilling fluid from the drill string; and, a tensioned linkage extending between the wear sensor and the flow resistance altering means. On detecting a predetermined degree of wear, the wear sensor releases the tension in the tensioned linkage. This activates the flow resistance altering device, causing the flow rate and/or pumping pressure of the drilling fluid to change. This serves as a signal that the predetermined wear condition has been achieved. The bit wear indicator can be adapted to monitor many different types of bit wear, including bearing wear in roller-cone type bits and gauge wear in all types of bits.

21 Claims, 4 Drawing Sheets

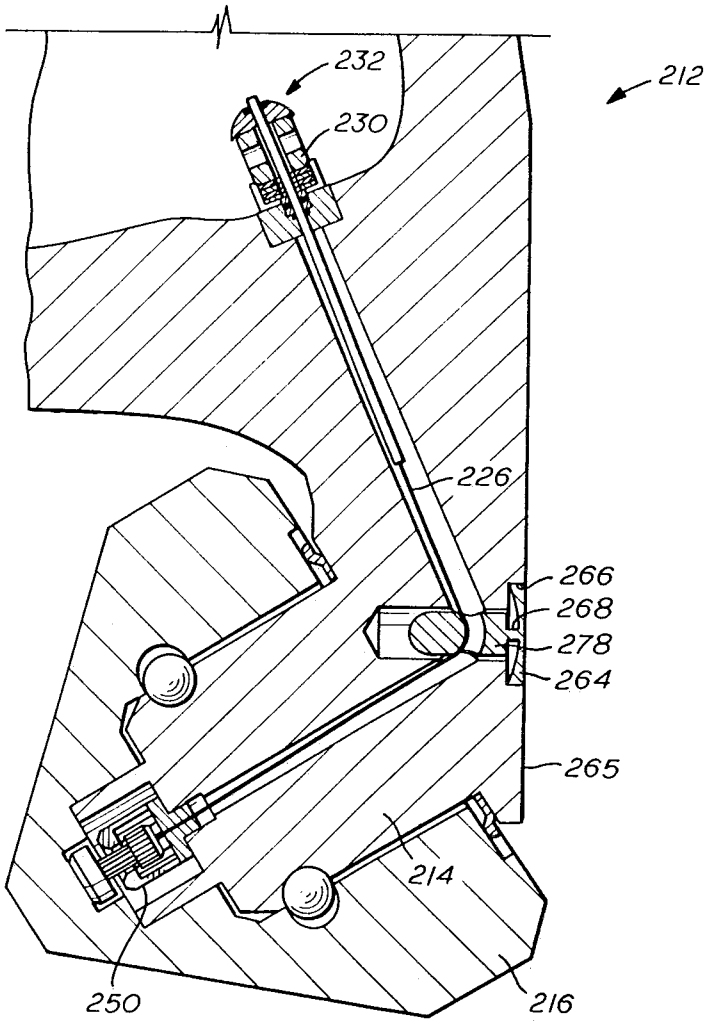
FIG. 9
FIG. 7
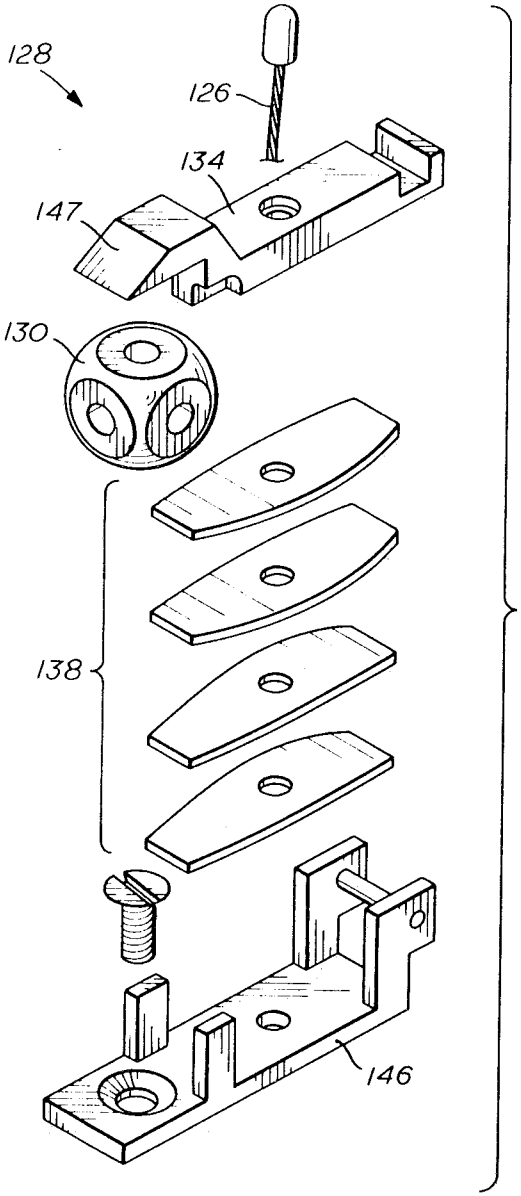

APPARATUS FOR DETECTING DRILL BIT WEAR

FIELD OF THE INVENTION

The present invention relates generally to bits used in drilling earth formations. More specifically, the present invention concerns a method and apparatus for detecting and signaling that a drill bit has reached a predetermined level of wear.

BACKGROUND OF THE INVENTION

Modern drilling operations used to create boreholes in the earth for the production of oil, gas and geothermal energy typically employ rotary drilling techniques. In rotary drilling, a borehole is created by rotating a tubular drill string having a drill bit secured to its lower end. As drilling Proceeds, additional tubular segments are added to the drill string to deepen the hole. While drilling, a pressurized fluid is continually injected into the drill string. This fluid passes into the borehole through one or more nozzles in the drill bit and returns to the surface through the annular channel between the drill string and the walls of the borehole. The drilling fluid carries the rock cuttings out of the borehole and also serves to cool and lubricate the drill bit.

The most common type of bit used in rotary drilling is known as a rotary-cone bit. Rotary-cone bits have two or more spindles at their lower end with each spindle serving as an axle for a rotary cutting element known as a cone. The spindles and cones are configured so that the cones bear on the bottom of the borehole. As the drill string and bit are rotated, the cones turn on the spindles. The outer face of each cone is provided with steel teeth or tungsten-carbide inserts which penetrate into the bottom of the borehole as the drill string turns, thus deepening the borehole.

A second type of bit, known as a drag bit, does not employ any moving components. Drag bits have a main body into the outer surface of which are embedded extremely hard cutting elements. These cutting elements are typically made of synthetic diamonds. As the drag bit is rotated, the cutting elements scrape against the bottom and sides of the borehole to cut away rock.

All types of drill bits undergo wear in the course of drilling operations. One type of wear is the dulling of the cutting elements. This generally causes the cutting ability and penetration rate of the bit to decrease with increasing usage. This decrease in the penetration rate is readily observable at the surface, permitting the driller to pull the drill string at the appropriate point to replace the bit.

There are other types of wear, not readily apparent at the surface, which have posed longstanding problems for the drilling industry. One of these is loss of gauge. Each drill bit is designed to drill a borehole of a specific gauge (diameter). As drilling progresses, the gauge maintaining Portion of the bit abrades against the borehole wall, decreasing the diameter of the bit. This causes the diameter of the drilled hole to progressively decrease. An undergauge borehole can damage a new drill bit and increase the likelihood of differential pressure sticking of the drill string within the borehole, among other problems. Where a hole is drilled undergauge, it is generally necessary to enlarge the diameter of the hole with a special reaming tool. This is a time-consuming and expensive operation.

A second type of wear is specific to roller-cone bits. In roller-cone drilling operations, the bearing surfaces between each cone and spindle will wear. As these surfaces wear, the cone will begin to rotate eccentrically about the spindle. If drilling continues, the cone may eventually seize or fall off the spindle. If a bit bearing should fail and leave a cone in the wellbore, it is often necessary to withdraw the drill string and suspend drilling operations until the lost cone can be fished from the well. The resulting delay can be very expensive, particularly in offshore wells.

It has long been desired to develop an inexpensive and reliable means for indicating when a bit is about to go undergauge or lose a cone. At present, drillers often elect to replace the bit well before they think it likely that a problem has developed to avoid the possibility of needing to fish a cone or ream the well. These bits are often discovered to have considerable life remaining when they are brought to the surface. If there were some means for indicating when a wear-related problem is about to arise, each bit could be used for its maximum effective life, reducing the time and cost of drilling a well.

SUMMARY OF THE INVENTION

The present invention is directed to an earth drilling bit adapted to sense and indicate when a specific portion of the bit has reached a predetermined degree of wear. The bit incorporates a wear indicator having the following principal features: a wear sensor; means for altering the drilling fluid flow resistance of the bit; and, a tensioned linkage secured between the wear sensor and the flow resistance altering means. On sensing a predetermined degree of wear, the wear sensor relieves the tension on the tensioned linkage. This activates the flow resistance altering means, causing a significant change in the flow rate and/or pumping pressure of the drilling fluid. This change is detected at the drilling rig, permitting the driller to decide to pull the drill string to change the bit.

A first preferred embodiment of the bit wear indicator is adapted for monitoring the wear of the cone bearings of a roller-cone bit. The wear sensor serves as an anchor for one end of the tensioned linkage. In response to the bearings reaching a predetermined state of wear, the wear sensor begins to rotate with the cone. After several revolutions, the tensioned linkage fails in torsion, activating the flow resistance altering means. Alternatively, the wear sensor can be adapted to be activated in response to the cone moving outward from the spindle.

In another preferred embodiment, a guide element is situated at an angled portion of the bit passageway through which the tensioned linkage passes. The passageway includes two lengthy holes drilled through the bit body. These holes intersect at an angle. A third, larger diameter hole is bored into the bit to intersect the other two holes. A guide element is inserted into this hole. This guide element incorporates a curving passageway which serves as a roundabout fairlead to guide the tensioned linkage from the first hole into the second hole in the installation of the tensioned linkage.

BRIEF DESCRIPTION OF THE DRAWINGS

For a better understanding of the present invention, reference may be had to the drawings, in which:

FIG. 7 is an exploded view of the blocking element retaining means of the embodiment shown in FIG. 6;

FIG. 9 is a sectioned view of a bit leg incorporating a fourth embodiment of the present invention.

These drawings are not intended to in any way define the present invention, but are provided solely for the purpose of illustrating certain preferred embodiments and applications of the present invention.

DESCRIPTION OF THE PREFERRED EMBODIMENTS

Introduction

Figure 1:
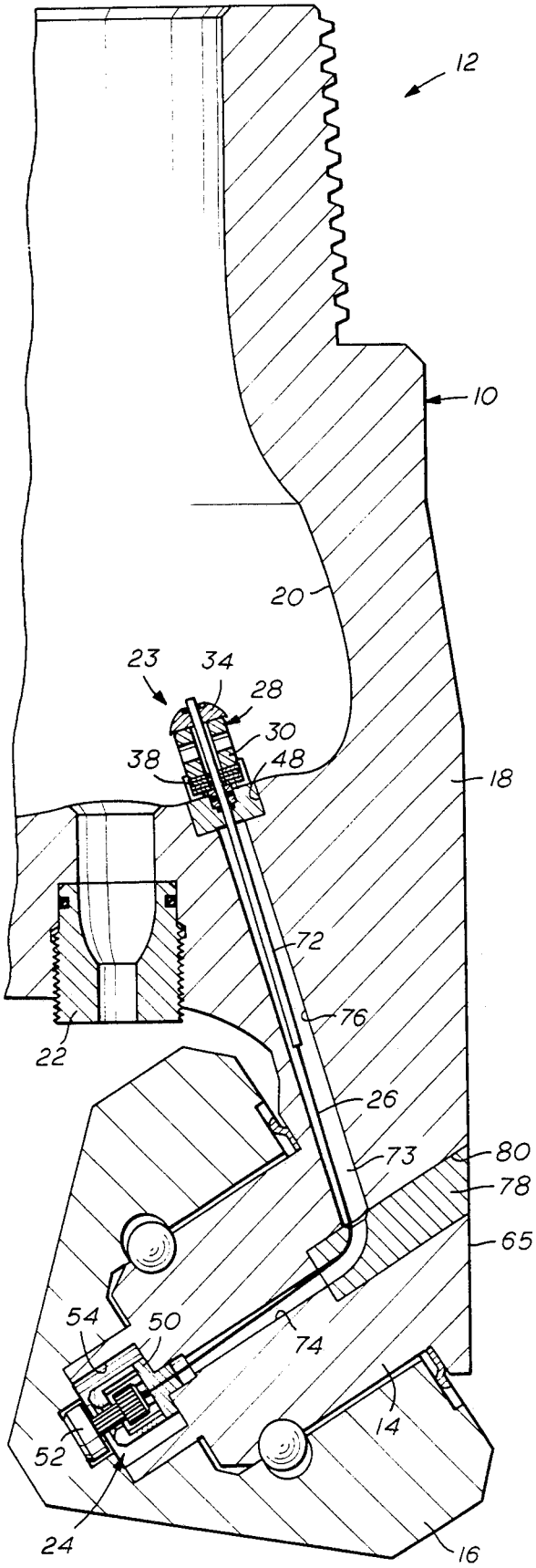
FIG. 1 is a view in vertical section of a bit leg incorporating a preferred embodiment of the present invention.

FIG. 1 shows a single bit leg 10 of a rotary cone drill bit 12 incorporating a preferred embodiment of the present invention. The drill bit 12 has two or more legs 10, each having a spindle 14 serving as a journal for a rotatable cutting element ("cone") 16. The individual legs 10 are welded together in the bit manufacturing process to form the main body 18 of the bit 12. The main bit body 18 defines a central chamber 20 of the bit 12. The bit 12 is provided with a number of ports 22, often referred to as nozzles, through which drilling fluid is injected downward onto the rock formation below the bit throughout drilling operations.

The present invention shall be generally referred to herein as a bit wear indicator 23. In one embodiment, the bit wear indicator 23 is adapted for detecting and signaling wear of the bearing interface between the cone 16 and spindle 14 of a roller-cone bit. This permits the driller to replace the bit before bearing wear reaches the point where there is a risk of losing a cone 16 in the wellbore. In another embodiment, the bit wear indicator 23 is used to detect and signal wear of the radially outermost surfaces of the bit legs 10. This permits the driller to replace the bit 12 when its gauge (diameter) has been reduced a preselected amount. This avoids the possibility of drilling an undergauge borehole.

The bit wear indicator 23 broadly includes the following principal components: a wear sensor 24; a tensioned linkage 26; and means 28 for altering the drilling fluid flow resistance of the bit 12 in response to a change in the tension of the tensioned linkage 26. In the preferred embodiment, shown in FIG. 1, the flow resistance altering means 28 includes a port blocking element 30 and means 32 for retaining the blocking element 30 at a fixed position within the bit 12 until the tension in the tensioned linkage 26 is reduced. The tensioned linkage 26 is preferably a metallic wire secured in tension between the wear sensor 24 and the blocking element retaining means 32. The wear sensor 24 is adapted and situated to detect wear at a selected point on the bit 12. As will be further described below, many types of wear sensors 24 may be used to detect various types of bit wear.

Operation of the bit wear indicator 23 is straightforward. When the wear sensor 24 detects a predetermined degree of wear, it releases the end of the tensioned linkage 26 connected to it. This relieves the tension of the tensioned linkage 26, causing the blocking element 30 to be released into the bit central chamber 20. The flow of drilling fluid through the central chamber 20 carries the blocking element 30 into one of the drilling fluid ports 22' reducing or completely stopping the flow of drilling fluid therethrough. This causes a significant increase in the pumping pressure of the drilling fluid. This pressure increase serves to indicate to the driller that the predetermined wear limit of the bit 12 has been reached.

It is anticipated that in the most common application the present invention will be incorporated into a roller-cone bit for detecting wear of the cone bearings. However, it must be keep in mind that the present invention can also be used to monitor wear of the gauge maintaining portions of any type of bit. Accordingly, the usefulness of the present invention is not limited to roller-cone bits.

Specific aspects of the preferred embodiments of the present invention will now be described in greater detail.

Blocking Element Retention and Release System

As discussed above, a principal component of the bit wear indicator 23 is means 28 for altering the drilling fluid flow resistance of the bit 12 in response to a change in the tension of the tensioned linkage 26. In the preferred embodiment, this flow resistance altering means 28 includes a port blocking element 30, such as a ball sized to obstruct a drilling fluid port 22, and means 32 for retaining the blocking element 30 at a fixed position until the tension in the tensioned linkage 26 is relieved. More broadly, however, the flow resistance altering means 28 can be any system for increasing or decreasing the resistance of the bit 12 to drilling fluid flow. For example, as an alternative to use of the blocking element 30 and retaining means 32, the flow resistance altering means 28 could be a port in the bit body 18 which is controlled by a valve adapted to open or close the port in response to a reduction in the tension of the tensioned linkage 26. This would serve to decrease or increase, respectively, the resistance of the bit 12 to drilling fluid flow, thus serving to indicate that the predetermined wear condition has occurred.

Figure 2:
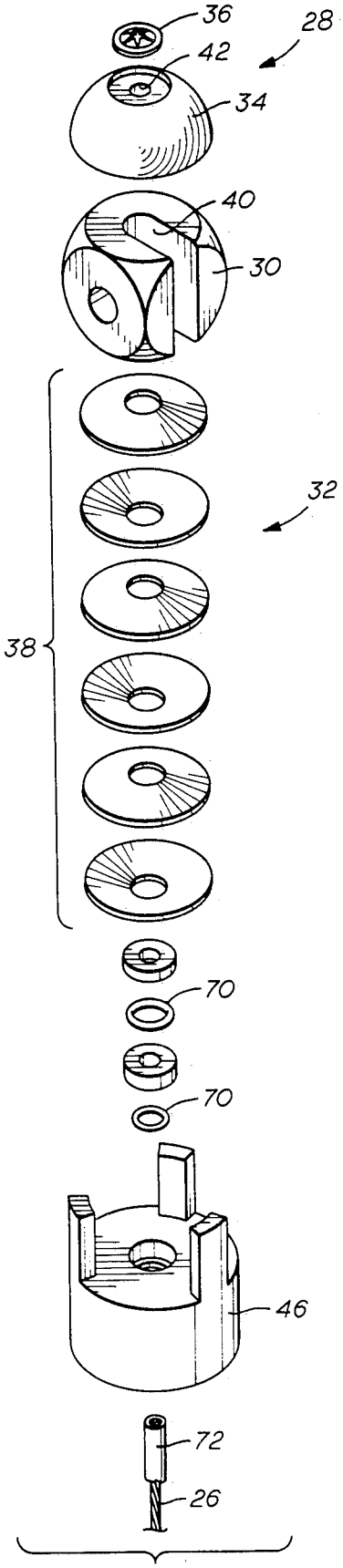
FIG. 2 is an exploded view of the blocking element retaining means of the embodiment shown in FIG. 1.

FIG. 2 shows an exploded view of a preferred embodiment of the port blocking element 30 and the retaining means 32. The blocking element 30 is preferably designed to obstruct, but not completely block, the flow of drilling fluid through the port 22. This may be accomplished by providing the blocking element 30 with holes extending through it, as shown in FIG. 2. This prevents the possibility of completely losing the ability to circulate drilling fluid in the event all of the wear sensors 24 are activated. In some applications it will be desirable to make the blocking element 30 out of a material which will erode after being subjected to drilling fluid flow for a few minutes. This will permit the driller to regain unrestricted circulation a short time after activation of the wear sensor 24.

The retaining means 32 includes the following principal components: a retainer element 34; means 36 for securing the tensioned linkage 26 to the retainer element 34 so that when under tension, the tensioned linkage 26 biases the retainer element 34 toward the bit body 18 to retain the blocking element 30 in a fixed position; and, a spring 38 for biasing the retainer element 34 away from the bit body 18 so that when the tension in the tensioned element 26 is relieved, the retainer element 34 is forced away from the bit body 18 to free the blocking element 30. In the preferred embodiment, the retainer element 34 is a small dome-shaped piece which rests atop the blocking element 30. The tensioned linkage 26 extends through a slot 40 in the blocking element 30 and a central hole 42 in the retainer element 34. A pushnut fastener, preferably a sleevelock, serves as the means 36 for securing the tensioned linkage 26 to the retainer element 34. The pushnut fastener 36 is locked to the tensioned linkage 26 immediately above the retainer element 34. When the tensioned linkage 26 is tensioned, the pushnut fastener 36 bears against the retainer element 34 to force it downward against the blocking element 30 to retain the blocking device 30 in a fixed position.

In the preferred embodiment, the retaining means 32 also includes a base portion 46 which is seated in a counterbore 48 in the bit body 18. The spring 38 is interposed in compression between the base portion 46 and the blocking device 30. When the tension on the tensioned linkage 26 is relieved, the spring 38 forces the blocking element 30 and retainer element 34 upward away from the base portion 46. At this point, the blocking element 30 is no longer tightly retained between the spring 38 and the retainer element 34. This causes the blocking device 30 to fall off the tensioned linkage 26 and enter one of the ports 22 under the action of the drilling fluid passing through the drill bit 12.

As illustrated in FIG. 2, the spring 38 is preferably a Belleville type spring. Each element of the Belleville type spring has a central aperture through which the tensioned linkage 26 passes. The spring 38 could alternately be a bow spring, a helical spring or other type of spring. For most applications it will be important that the spring 38 be made of a high strength corrosion resistant metal, such as ELGILOY®, adapted to withstand the high temperatures occurring in weld-up of the bit legs 10 without loss of spring force.

The preferred embodiment of the flow resistance altering means 28 described above provides many advantages. Because the tensioned linkage 26 passes through apertures in each element of the blocking element retaining means 32, each of these elements is retained in place on release of the blocking element 30. Because all of the elements are concentrically loaded, the size and complexity of the flow resistance altering means 28 is reduced. The blocking element 30 is completely captured by the retaining means 32 itself, so there is no need for a detent in the inner wall of the bit leg 10 for retaining the blocking element 30. All components of the retaining means 32 are very simple and may be inexpensively produced by a screw machine, investment casting or stamping. Also, as will be described more fully below, the simplicity of the preferred embodiment of the retaining means 32 simplifies sealing the tensioned linkage 26 against the entry of drilling fluid into the bit body passageway through which the tensioned linkage 26 extends.

Figure 6:
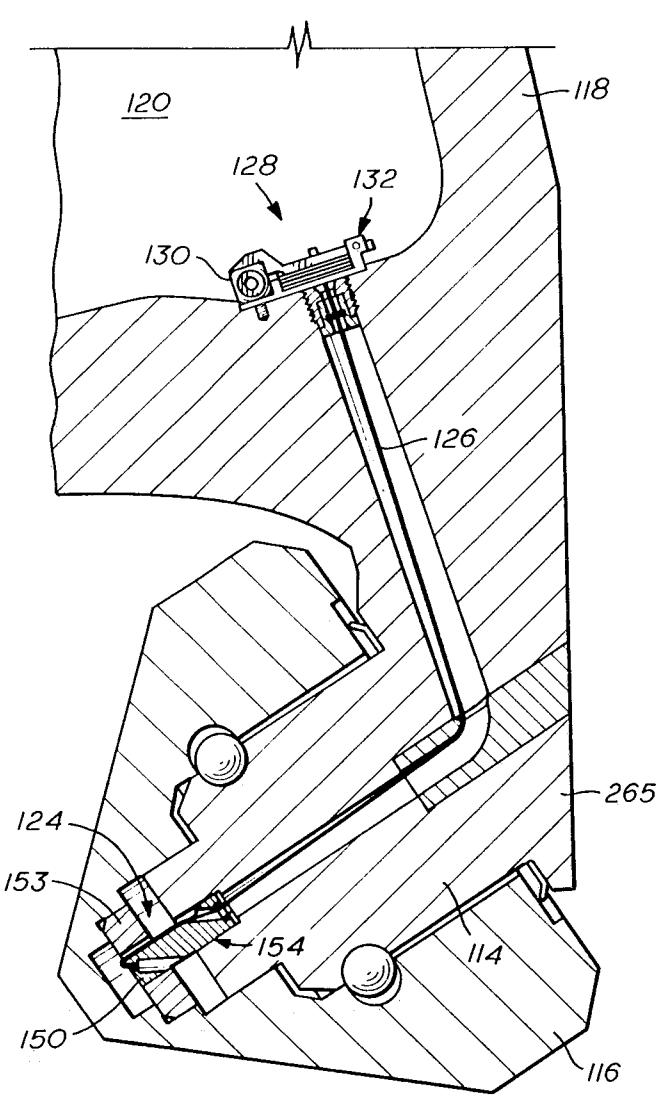
FIG. 6 is a sectioned view of a bit leg incorporating a third embodiment of the present invention.
Figure 5:
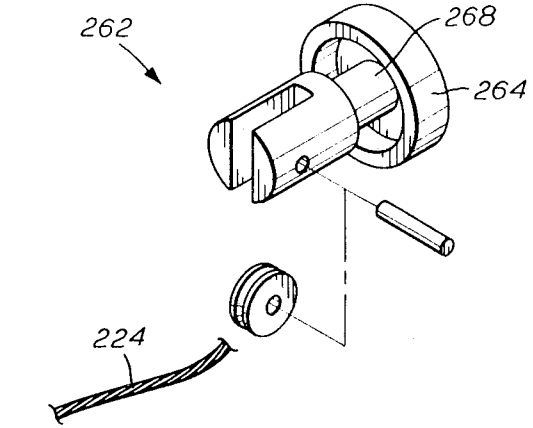
FIG. 5 is an exploded view of the gauge monitor of FIG. 4.

There are many other possible embodiments of the flow resistance altering means 28. FIGS. 6 and 7 show one such alternate embodiment. In this embodiment, the blocking device 130 is offset from the axis of the tensioned linkage 126. The base portion 146 of the retaining means 132 is secured to a flat on the main bit body 118 located within the central chamber 120 at a position directly above the tensioned linkage passageway. The retainer element 134 is hinged at one end to the base portion 146 and at the other end has a ball retaining portion 147. A bow spring 138 is interposed between the retainer element 134 and base portion 146. The tensioned linkage 126 passes through the base portion 146, spring 138, and retainer element 134 to compress the spring 138 and trap the blocking device 130 between the base 146 and the retainer element ball retaining portion 147. The principal of operation of this embodiment is the same as that of the preferred embodiment.

Wear Sensor

Figure 3:
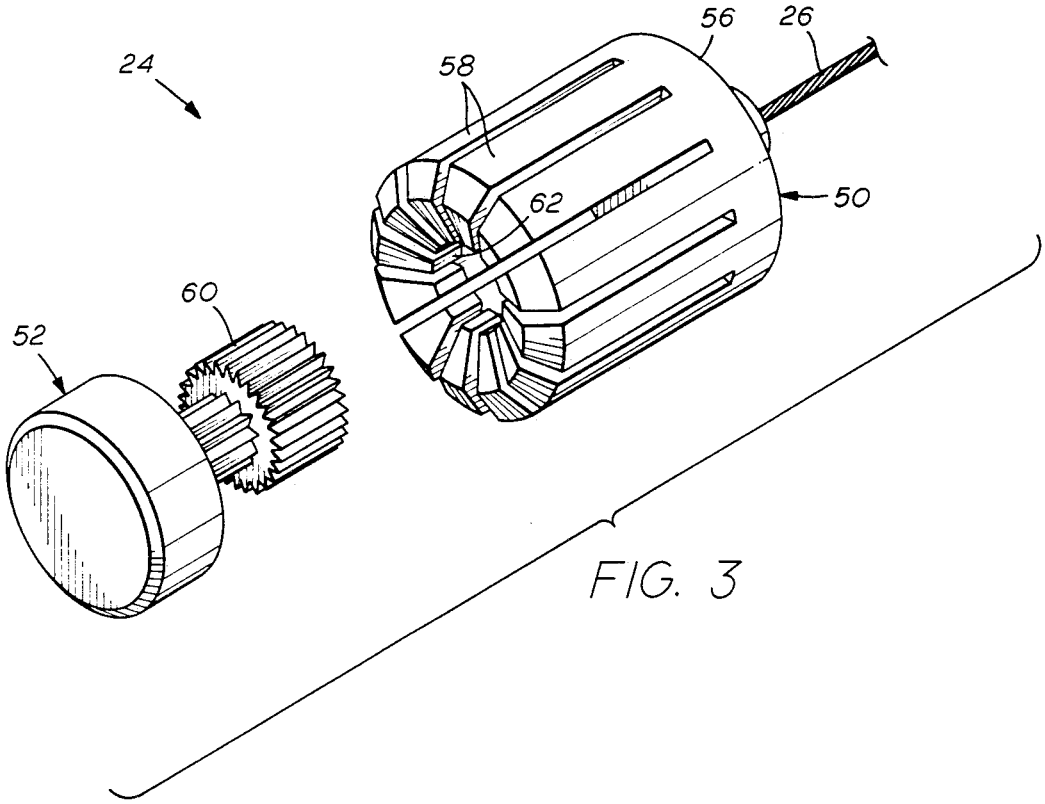
FIG. 3 is an exploded view of the bearing wear sensor shown in FIG. 1.

Broadly, the wear sensor 24 can be any element adapted to sense wear of any region of the bit 12 and relieve the tension in the tensioned linkage 26 in response to the occurrence of a predetermined degree of wear. FIGS. 1 and 3 illustrate the preferred embodiment of a wear sensor 24 adapted for sensing wear of the bit bearing of a roller-cone bit. This preferred wear sensor takes the form of a torsional and tensional trigger. Once the bearing has worn to the point that cone 16 rotates with sufficient eccentricity, the sensor 24 rotates the tensioned linkage 26 until it fails due to torsional strain.

As best shown in FIG. 3, the two principal components of the preferred wear sensor 24 are a tensioned linkage end termination element 50 and means 52 for causing the end termination element 50 to rotate in response to the occurrence of a predetermined degree of bearing wear. The end termination element 50 preferably takes the form of a snap ring type element such as a collet located in a recess 54 in the end face of the spindle 14. By recessing the collet 50 within the spindle 14, the potential for damaging the collet 50 in the course of bit assembly is minimized. The base 56 of the collet 50 bears on the bottom of the spindle recess 54. The tensioned linkage 26 is secured to the collet base 56. Thus, the collet 50 anchors one end of the tensioned linkage 26 against the spindle 14. The fingers 58 of the collet 50 project outwardly from collet base 56 to encircle a central axis substantially coaxial with the spindle 14.

The rotation causing means 52 preferably takes the form shown in FIG. 3. The rotation causing means 52 is press-fit into the cone 16, projecting into the collet 50 along the axis of cone rotation 16. The rotation causing means 52 has an enlarged end portion 60 with an outer diameter slightly smaller than the inner surface defined by the collet fingers 58. Accordingly, so long as the axis of rotation of the cone 16 lies on the axis of the spindle 14, the rotation causing means 52 does not interfere with the collet 50. However, when the bearing surface between the cone 16 and spindle 14 becomes sufficiently worn, the resulting eccentric rotation of the cone 16 will cause the enlarged end portion 60 of the rotation causing means 52 to interfere with the collet fingers 58. This causes the collet 50 to twist as the cone 16 rotates. As shown in the FIGURES, the outer surface of the rotation causing element 52 may be provided with axially extending grooves to enhance its ability to engage and rotate the collet 50. After sufficient rotation, the tensioned linkage 26 will fail in torsion, causing release of the port blocking element 30. For the preferred embodiment of the tensioned linkage 26, described below, we have found that 5 to 10 complete 360° rotations of the collet 50 will cause the tensioned linkage 26 to fail.

An additional feature of the preferred wear sensor 24 is that it also serves as a tensional trigger, severing the tensioned linkage 26 in response to the cone 16 moving a short distance axially outward along the spindle 14 from its design position. This is achieved by interference between the enlarged end portion 60 and a reduced diameter section 62 at the collet opening. This reduced diameter section 62 is chamfered inward to permit the rotation causing element 52 to spread the collet fingers 58 and be received within the collet 50 during assembly. However, following assembly the rotation causing element 52 cannot be withdrawn from the collet 50. Thus, if the cone 16 moves even a short axial distance away from its design position, it pulls the collet 50 and tensioned linkage 26 with it. This axial movement will exceed the ultimate tensile strength of the tensioned linkage 26 which will cause it to sever, releasing the blocking element 30.

Figure 8:
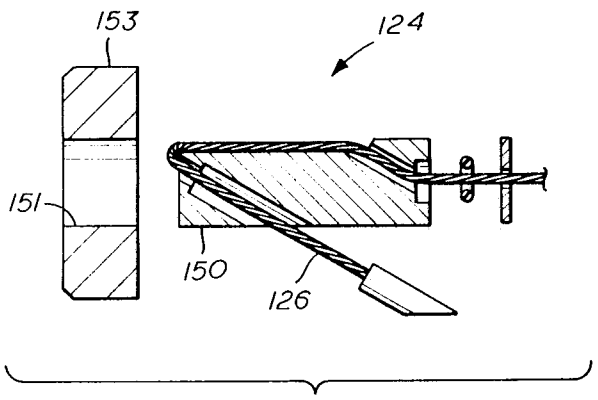
FIG. 8 is an exploded view of the abradable bearing wear sensor of the embodiment shown in FIG. 6.

There are many other possible embodiments of the wear sensor 24. FIGS. 6 and 8 show one such alternate embodiment. In this embodiment, the wear sensor 124 takes the form of an abradable trigger. The end of the tensioned linkage 126 is secured to a termination element 150 press-fit into a central aperture 154 in the end face of the spindle 114. The termination element 150 projects outward a short distance from the end of the spindle 114 into a central aperture 151 of a cutting element 153 in the cone 116. When the cone 116 begins to rotate eccentrically, the cutters of the cutting element 153 cut into the portion of the tensioned linkage 126 within the termination element 150, severing it. In the embodiment shown in FIGS. 6 and 8, the termination element 150 is arranged so that the portion of the tensioned linkage 126 to be severed is situated slightly offset from the central axis of the spindle 114. This offset is desirable because it allows the magnitude of the rotational eccentricity of the cone 116 (which is directly related to the degree of bearing wear) required for activating the wear sensor 124 to be readily adjustable. The greater the offset, the smaller is the degree of bearing wear required to sever the tensioned linkage 126.

Figure 4:
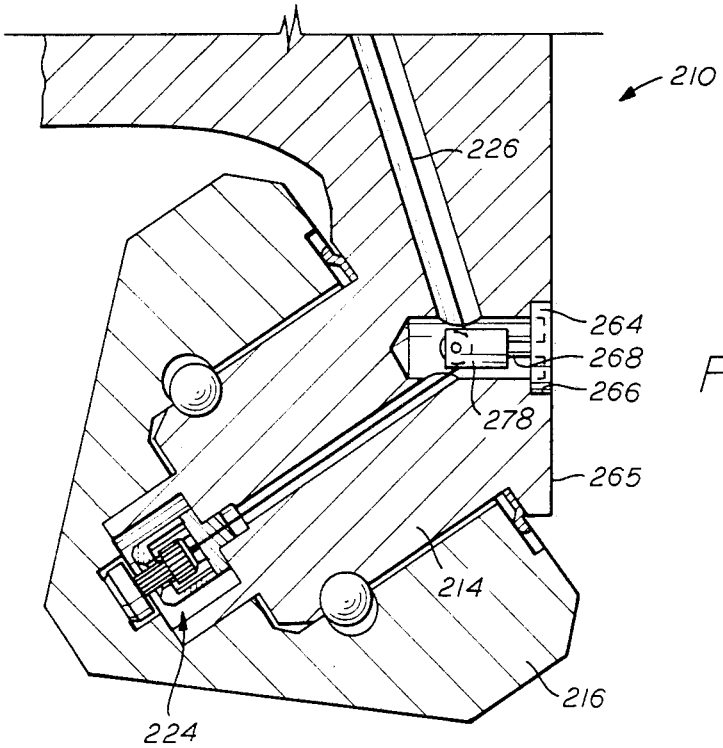
FIG. 4 is a sectioned view of a bit leg incorporating an alternate embodiment of the present invention adapted to monitor bit bearing wear and bit gauge wear.

FIGS. 4 and 9 show two types of wear sensors adapted for detecting gauge wear of a bit. In each of these embodiments, the bit also incorporates a bearing wear sensor. In each of these embodiments, the tensioned linkage 226 is supported by a guide element 278 positioned between the bearing wear sensor 224 and the blocking element retaining means 232. The guide element 278 has two principal portions: a large diameter portion 264 set in a corresponding aperture 266 in the outer wall ("shirt-tail") 265 of the bit; and a smaller diameter portion 268 projecting inward from the large diameter portion 264. The tensioned linkage 224 passes through a fairlead secured to the smaller diameter portion 268. As the shirt-tail 265 wears, the guide element large diameter portion 264 wears with it. After sufficient wear the small diameter portion 268 breaks free from the large diameter portion 264 and moves inward to reduce the tension on the tensioned linkage 226, causing the blocking element 230 to be released. The gauge wear sensor can be designed to trigger at any desired level of gauge reduction by varying the wall thickness of the larger diameter portion 264.

Another version of gauge wear sensor has one end of the tensioned linkage anchored in a bearing wear sensor and the other end anchored in the gauge wear sensor. In this configuration, the blocking element retaining means is positioned between the bearing wear and gauge wear sensor elements.

Tensioned Linkage

The tensioned linkage 26 can assume many forms. We have found that a seven strand 0.023 inch (0.53 mm) wire made of MP-35N, a high strength, corrosion resistant alloy, works particularly well. Those skilled in the art will recognize that many other types of wires, both metallic and non-metallic, and other types of tension bearing elongated elements will also be suitable for specific applications.

We have discovered that it is important to prevent the intrusion of drilling fluid into the passageway through which the tensioned linkage 26 extends in the bit body 18. This intrusion could permit drilling fluid to enter the bearing area, over-pressuring the bearing area and accelerating bearing wear. Such intrusion could also cause drilling fluid solids to pack off in the passageway through which the tensioned linkage 26 passes, locking the tensioned linkage 26 in place. This would impede proper functioning of the bit wear indicator 23. Accordingly, it is desirable to establish a seal 70 to prevent fluid flow along the tensioned linkage 26. In the preferred embodiment, shown in FIGS. 1 and 2, this is accomplished by placing one or more elastomer O-rings around the tensioned linkage 26 to seal off the region between the tensioned linkage 26 and the base portion 46 of the retaining means 32. To prevent wicking leakage between individual strands of a multistrand flexible wire when used as the tensioned linkage 26, the upper portion of the tensioned linkage 26 is jacketed in a thin-walled sleeve 72 made of a corrosion resistant alloy which is soldered to the tensioned linkage 26. This provides the tensioned linkage 26 with a continuous, smooth outer surface which greatly facilitates establishing an efficient seal. An alternate method of sealing the multistrand wire is to swedge the thin wall sleeve 72 to the tensioned linkage 26 and impregnate a suitable "Loc-tite" sealing fluid into the sleeve/wire assembly.

As illustrated in FIG. 1, the tensioned linkage 26 extends through a passageway 73 in the spindle 14 and the main bit body 18. The passageway 73 is made up of two intersecting passageway segments 74, 76. The first passageway segment 74 extends through the spindle 14 from the wear sensor 24. The second passageway segment 76 extends from the flow resistance altering means 28 to the end of the first passageway segment 74. To avoid weakening the bit 12, these passageway segments 74, 76 should have a small diameter, preferably 0.3 inches (7.5 mm) or less. In the FIGURES, the diameter of the passageway segments 74, 76 has been exaggerated for the purpose of clarity.

We have discovered three difficulties associated with establishing the passageway 73 for the tensioned linkage 26. First, it has proven difficult to drill these lengthy, small diameter holes with sufficient accuracy to ensure that they intersect at the desired point. Second, it is sometimes difficult to thread the tensioned linkage 26 through the juncture between the passageway segments 74, 76, even when they properly intersect. Third, after drilling the passageway segments 74, 76, their intersection forms a sharp interior corner which must be rounded by hand lapping to avoid imposing a high stress raiser on the tensioned linkage 26. To avoid these problems the preferred embodiment incorporates a guide element 78 at the juncture between the two passageway segments 74, 76. The guide element 78 serves as a fairlead roundabout which provides a relatively large radius of curvature for taking the tensioned linkage 26 through the angle at which the two passageway segments 74, 76 intersect. This avoids the high stress raiser and minimizes the "set" taken by the tensioned linkage 26. The guide element 78 also receives and guides the tensioned linkage 26 from one passageway to the other as the tensioned linkage 26 is inserted through the bit 12 in the course of assembly. As shown in the embodiment illustrated in FIG. 9, the guide element 278 and the gauge wear sensor can be incorporated into a single element.

Installation

The bit wear indicator 23 is preferably incorporated into the individual bit legs 10 before they are joined together. First, the two passageway segments 74, 76 are drilled. The second passageway segment 76 is drilled only deep enough to reach the first passageway segment 74. The first passageway segment 74, however, is drilled from a position proximate the center of the spindle end face until it exits through the surface of the shirt-tail 65. At the point where it extends through the shirt-tail 65, this hole is used as a pilot for drilling a bore 80. The bore 80 extends from the shirt-tail 65 to a position slightly past the intersection of the first and second passageway segments 74, 76. The guide element 78 is situated in the bore 80. Using the first passageway segment 74 as a pilot for the bore 80 ensures that the guide element 78 is centered on the first passageway segment 74. This facilitates installation of the tensioned linkage 26. The counterbores 48, 54 for the retaining means base portion 46 and the collet 50 can be machined at any point in the manufacturing process convenient for these operations.

From this point, the bit wear indicator 23 is easily and quickly installed using hand labor. The wire 26 is preassembled to the thin-walled sleeve 72. The wire 26 is threaded through the second passageway segment 76 until it emerges through the collet counterbore 54. The wire 26 is secured to the base 56 of the collet 50 by swedging. The blocking element 30 and the elements of the retaining means 32 are then threaded onto the thin-walled sleeve 72 in the proper order. A sleevelock 36 is then placed on the thin-walled sleeve 72. The sleevelock 36 is oriented to permit the sleeve 72 to pass through it only in the upward direction. A tensioning tool (not shown) is inserted above the sleevelock and grips the upper portion of the sleeve 72 while forcing the sleevelock 36 down against the retainer element 34. This forces the sleevelock 36 down over the sleeve 72 until all the elements of the bit wear indicator 23 are fully seated and the spring 38 is fully compressed. The sleeve 72 is then clipped off immediately above the sleevelock 36.

The preferred embodiments of the present invention have been described above. It should be understood that the foregoing description is intended only to illustrate certain preferred embodiments of the invention and is not intended to define the invention in any way. Other embodiments of the invention can be employed without departing from the full scope of the invention as set forth in the appended claims.

We claim:

1. A rotary cone drill bit, comprising:

a main bit body, said main bit body defining a central chamber;

at least one port in said main bit body establishing a fluid pathway between said central chamber and the exterior of said main bit body;

at least one spindle secured to said main bit body;

a rotatable cone on said spindle;

a tensioned linkage extending through said spindle and said main bit body, said tensioned linkage having first and second ends;

a tensioned linkage termination element secured to said tensioned linkage first end, said termination element being supported by said spindle;

means for twisting said termination element in response to said cone rotating with a predetermined degree of eccentricity, said termination element and tensioned linkage being adapted to part from one another in response to twisting of said termination element; and means for altering the fluid flow resistance of said at least one port in response to a decrease in the tension of said tensioned linkage.

2. The rotatable cone drill bit as set forth in claim 1, wherein said flow resistance altering means includes:

a blocking element within said main bit body, said blocking element being adapted to at least partially block fluid flow through said port in response to said blocking element being released; and means for releasably retaining said blocking element at an initial position within said bit body in response to said tensioned linkage being maintained in tension and for releasing said blocking element in response to a decrease in the tension of said tensioned linkage.

3. The rotary cone drill bit as set forth in claim 1, wherein said termination element is a collet, said collet being substantially coaxial with said spindle.

4. The rotary cone drill bit as set forth in claim 3, wherein said twisting means is an element secured to said cone and projecting to a position within said collet.

5. The rotary cone drill bit as set forth in claim 4, wherein said collet has a reduced diameter end portion and wherein said twisting element has two sections:

an end section within said collet, said end section having a diameter greater than said collet end portion; and a shaft extending between said cone and said end section, said shaft having a diameter smaller than said collet reduced diameter end portion.

6. The rotary cone drill bit as set fort in claim 1, wherein said tensioned linkage extends through a passageway in said bit body, said passageway including two intersecting passageway segments, there being a guide element situated at the intersection between said passageway segments, said guide element defining a curved channel linking said passageway segments, said guide element being fabricated separately from said bit body and inserted into said bit body.

7. A rotary cone drill bit, comprising:

a main bit body having an interior chamber;

a port in said bit body extending between said interior chamber and the exterior of said bit body;

a spindle secured to said bit body;

a cutting element rotatably secured on said spindle;

a tensioned linkage extending through said spindle and bit body, said tensioned linkage having first and second ends;

a passageway extending through said spindle and bit body, said tensioned linkage extending through said passageway, said passageway including two passageway segments, said passageway segments intersecting at an angle within said bit;

a guide element at the intersection between said passageway segments, said guide element defining a curved channel linking said two passageway segments, said guide element being an insert within the bit body;

a tensioned linkage termination element secured to said tensioned linkage first end, said termination element being supported on said spindle;

means for twisting said termination element in response to said cone rotating with a predetermined degree of eccentricity, said termination element and tensioned linkage being adapted to part from one another in response to twisting of said termination element; and means for altering the fluid flow resistance of said port in response to a decrease in the tension of said tensioned linkage, said tensioned linkage second end being secured to said flow resistance altering means.

8. The rotary cone drill bit as set forth in claim 7 further comprising:

means for causing said termination element and tensioned linkage to part from one another in response to said cone moving a preselected distance axially outward from an initial position on said spindle.

9. The rotatable cone drill bit as set forth in claim 7, wherein said flow resistance altering means includes:

a blocking element within said main bit body, said blocking element being adapted to at least partially block fluid flow through said port in response to said blocking element being released; and means for releasably retaining said blocking element at an initial position within said bit body in response to said tensioned linkage being maintained in tension and for releasing said blocking element in response to a decrease in the tension of said tensioned linkage.

10. The rotary cone drill bit as set forth in claim 7, wherein said cutting element is a cone.

11. A rotary cone drill bit. comprising:

a main bit body having an interior chamber;

a port in said bit body extending between said interior chamber and the exterior of said bit body;

a spindle secured to said bit body;

a rotatable cutting element on said spindle;

a tensioned linkage extending through said spindle and bit body, said tensioned linkage having first and second ends;

a passageway extending through said spindle and bit body, said tensioned linkage being situated within said passageway, said passageway including two passageway segments, said passageway segments intersecting at an angle within said bit;

a guide element at the intersection between said passageway segments, said guide element defining a curved channel linking said two passageway segments;

a tensioned linkage termination element secured to said tensioned linkage first end, said termination element being supported on said spindle;

means for causing said termination element and tensioned linkage to part from one another in response to said cone moving a prescheduled distance axially outward from an initial position on said spindle; and means for altering the flow resistance of said port in response to a decrease in the tension of said tensioned linkage, said tensioned linkage second end being secured to said flow resistance altering means.

12. The rotatable cone drill bit as set forth in claim 11, wherein said flow resistance altering means includes:

a blocking element within said main bit body, said blocking element being adapted to at least partially block fluid flow through said port in response to said blocking element being released; and means for releasably retaining said blocking element at an initial position within said bit body in response to said tensioned linkage being maintained in tension and for releasing said blocking element in response to a decrease in the tension of said tensioned linkage.

13. The rotary cone drill bit as set forth in claim 1, wherein said tensioned linkage is a metallic wire.

14. The rotary cone drill bit as set forth in claim 1, wherein said guide element is situated within a bore in said bit body, said bore extending into the intersection between said first and second passageway segments.

15. A rotary cone drill bit, comprising:

a main bit body having an interior chamber;

a port in said bit body extending between said interior chamber and the exterior of said bit body;

a spindle secured to said bit body;

a rotatable cutting element on said spindle;

a tensioned linkage extending through said spindle and bit body, said tensioned linkage having first and second ends;

a tensioned linkage termination element secured to said tensioned linkage first end, said termination element being supported on said spindle;

means for causing said termination element and tensioned linkage to part from one another in response to said cone moving a prescheduled distance axially outward from an initial position on said spindle; and means for altering the fluid flow resistance of said port in response to a decrease in the tension of said tensioned linkage, said tensioned linkage second end being secured to said flow resistance altering means.

16. A drill bit, comprising:

a main bit body defining a central chamber;

at least one port in said main bit body establishing a fluid pathway between said central chamber and the exterior of said main bit body;

a sensor connected to a selected location on said drill bit to detect wear of said drill bit proximate said selected location;

a blocking element within said main bit body, said blocking element being adapted to at least partially block fluid flow through said port in response to said blocking element being released within said main bit body, said blocking element defining a slot extending therethrough;

means for releasably retaining said blocking element at an initial position within said bit body, said retaining means including a retainer; and a tensioned linkage connected between said wear sensor and said retainer element, said tensioned linkage extending through the slot in said blocking element, whereby on relieving the tension on said tensioned linkage, said blocking element will fall away from said tensioned linkage.

17. The drill bit as set forth in claim 16, wherein said retaining means includes a spring, said spring being interposed between said bit body and said blocking element with said tensioned linkage maintaining said spring in an initially compressed condition with said blocking element being trapped between said retainer element and spring, whereby on release of the tension in said tensioned linkage, said spring forces said retainer element and said blocking element away from said initial position.

18. The drill bit as set forth in claim 17, wherein said spring element is a Belleville type spring, said Belleville type spring having an aperture through which said tensioned linkage passes.

19. The drill bit as set forth in claim 16, wherein said tensioned linkage is a braided metallic wire.

20. The drill bit as set forth in claim 16, wherein said tensioned linkage is a non-metallic fiber wire.

21. The drill bit as set forth in claim 16, wherein said tensioned linkage extends through a passageway in said bit body, said passageway including two intersecting passageway segments, there being a guide element situated at the intersection between said passageway segments, said guide element defining a curved channel linking said passageway segments, said guide element being fabricated separately from said bit body and inserted into said bit body.

* * * * *